United States Patent [19]

Roberts et al.

[11] Patent Number: 4,824,478

[45] Date of Patent: Apr. 25, 1989

[54] METHOD AND APPARATUS FOR PRODUCING FINE METAL POWDER

[75] Inventors: Peter R. Roberts; James J. Airey, both of Groton; James E. Blout, Concord; Joseph J. Airey, Groton, all of Mass.

[73] Assignee: Nuclear Metals, Inc., Concord, Mass.

[21] Appl. No.: 161,979

[22] Filed: Feb. 29, 1988

[51] Int. Cl.[4] ..... B22F 9/08; B22F 9/10

[52] U.S. Cl. ..... 75/0.5 C; 264/8; 264/10; 264/14; 425/7; 425/8

[58] Field of Search ..... 75/0.5 C, 0.5 B; 264/8, 264/10, 14; 425/7, 8

[56] References Cited

U.S. PATENT DOCUMENTS

| | | | |
|---|---|---|---|
| 2,439,772 | 4/1948 | Gow | 264/8 |
| 3,099,041 | 7/1963 | Kaufmann | 264/8 |
| 3,329,746 | 7/1967 | Joyce et al. | 425/8 |
| 4,217,082 | 8/1980 | Bourdeau | 425/8 |
| 4,405,535 | 9/1983 | Raman et al. | 264/11 |
| 4,468,241 | 8/1984 | Breidenthal, Jr. | 425/8 |

*Primary Examiner*—Wayland Stallard

*Attorney, Agent, or Firm*—Joseph S. Iandiorio; Brian M. Dingman

[57] ABSTRACT

A method and apparatus for producing fine metal powder. The method includes the steps of forming a centrifugally maintained annulus of a liquified gas quench medium, forming molten metal drops within the eye of the annulus, urging the drops into the quench medium to solidify the drops, and boiling away the quench medium to leave behind clean, unentrained metal powder. The apparatus includes a drum for containing a liquified gas quench medium, means for adding liquified gas to the inside of the drum, and means for rotating the drum to form an annulus of quench medium. The apparatus further includes means for forming molten metal to be made into powder, and means disposed along the longitudinal axis of the drum and within the eye of the annulus for creating molten metal drops. The molten metal drops are then urged into the quench medium to solidify them into a powder, and the quench medium is boiled away to leave behind clean, unentrained metal powder.

39 Claims, 4 Drawing Sheets

METHOD AND APPARATUS FOR PRODUCING FINE METAL POWDER

FIELD OF INVENTION

This invention relates to a method and apparatus for producing fine metal powder and more particularly to such a method and apparatus which uses a liquified gas quench for centrifugally formed molten droplets.

BACKGROUND OF INVENTION

Very fine metal powders, especially extremely pure, spherical powders, are useful for a variety of purposes. Powders with diameters in the range of approximately 50–100 micrometers are ideally suited for powder metallurgy because they pour well, will fill extremely small mold voids, and are relatively dense when tapped down. These powders thus allow extremely pure small metal parts to be made with a consistent size and density.

To date, the most favored method of producing clean, fine powder has been the plasma rotating electrode process or PREP. This process was disclosed in U.S. Pat. No. 3,099,041, and consists of melting a rotating metallic electrode with a plasma arc and quenching the resulting metal drops in air, an inert gas atmosphere, and/or a water bath. The PREP process produces relatively fine, pure powder typically in the size range 45–500 micrometers in diameter but is not well suited for economical production of the small amounts of specialty metal powders currently in great demand. A primary reason for this is that the PREP apparatus is extremely large, and consists of many parts. After a powder making run is complete, the apparatus must be thoroughly cleaned, which involves partial disassembly of the equipment and a thorough cleaning of all parts exposed to the fine powder. The meticulous cleaning required to ensure a contaminant-free product in the next run takes many man hours of time, and is costly both in labor costs and machine down-time. Because of these problems, PREP has not been able to fill the need created by the demand for specialty powders.

Another problem with PREP is the physical size and complexity of the apparatus. The PREP chamber must be large enough to allow the molten metal drops to solidify before they hit the surface of the chamber. Typically, these chambers have a diameter of approximately eight feet or more to provide the necessary cooling time. The support equipment required to spin the electrode and to centrifugally maintain the quench bath if used are massive. The water quench PREP apparatus also requires settling tanks and/or an extremely fine filter apparatus to separate the powder entrained in the quench medium. All this equipment requires substantial manufacturing space, is extremely expensive, and is, as described above, difficult to clean.

SUMMARY OF INVENTION

It is therefore an object of this invention to provide a method and apparatus for producing fine metal powder that is well suited for making small amounts of specialty powders.

It is a further object of this invention to provide an apparatus for producing fine metal powder that is inexpensive and compact.

It is a further object of this invention to provide an apparatus for producing fine metal powder that is easy to clean.

It is a further object of this invention to provide an apparatus for producing fine metal powder that does not require separate powder separation equipment.

It is a further object of this invention to provide a method and apparatus for producing fine metal powder in which the median particle size can be controlled.

It is a further object of this invention to provide a method and apparatus for producing fine metal powder that is capable of making powder with a mean diameter as small as 50 micrometers.

It is a further object of this invention to provide a method and apparatus for producing fine metal powder that produces an extremely clean powder.

This invention results from the realization that the method and apparatus for producing fine metal powder can be greatly simplified and improved by quenching centrifugally formed molten metal drops in a liquified gas quench medium that is readily evaporated to leave an extremely fine powder confined within the interior of the apparatus.

This invention features a method and apparatus for producing fine metal powder. The method includes the steps of forming a centrifugally maintained annulus of a liquified gas quench medium, forming molten metal drops within the eye of the annulus, urging the drops into the quench medium to solidify them, and boiling away the quench medium to leave behind clean, unentrained metal powder. The quench medium is preferably boiled away by maintaining an ambient temperature proximate the boiling point of the liquified gas. Preferably, the liquified gas is either liquid argon or liquid nitrogen. Liquid argon is an inert gas that produces an extremely clean powder, but liquid nitrogen is a less expensive alternative that is also relatively non-reactive with many liquid metals. Preferably, the molten metal drops are formed from a consumable electrode that may be melted by a plasma torch that supplies an arc to the electrode. The electrode is melted to form molten metal, and the drops are preferably flung into the quench medium by rotating the electrode at speeds up to 20,000 rpm. Alternatively, the molten metal drops can be formed by breaking up a molten metal stream into drops. This is preferably accomplished by providing a rotating cup or dish-shaped member that breaks the stream into drops and directs them toward the annulus. The member may be made from a relatively inert material that does not react with the molten metal, for example graphite.

Preferably, the annulus of quench medium is formed on the inside surface of a rotating drum and the drops are urged into the quench medium by a rotating member that flings the drops into the annulus. Greater relative velocity differential between the liquid metal drops and the quench medium can be provided by independently rotating the drum and the member that forms the drops and flings them into the annulus. Preferably, both the rotating member and the drum are rotated at a variable angular velocity, with the rotating member rotating at up to 20,000 rpm and the drum at up to 3,000 rpm. As the quench medium quickly evaporates at room temperature, the quench medium is preferably replenished as it evaporates to maintain an annulus with a substantially constant thickness to continually solidify the droplets before they hit the drum wall. An inert gas atmosphere may be provided within the eye of the annulus to prevent powder contamination.

Ideally, the drum that holds the annulus has at least one partially open end to vent the evaporating gas. The liquid metal drops are preferably created from a consumable electrode, disposed along the longitudinal axis of the drum and rotating therein, by melting the electrode with a plasma torch that supplies an arc to it.

DISCLOSURE OF PREFERRED EMBODIMENT

Other objects, features and advantages will occur from the following description of a preferred embodiment and the accompanying drawings, in which.

Figure 1:
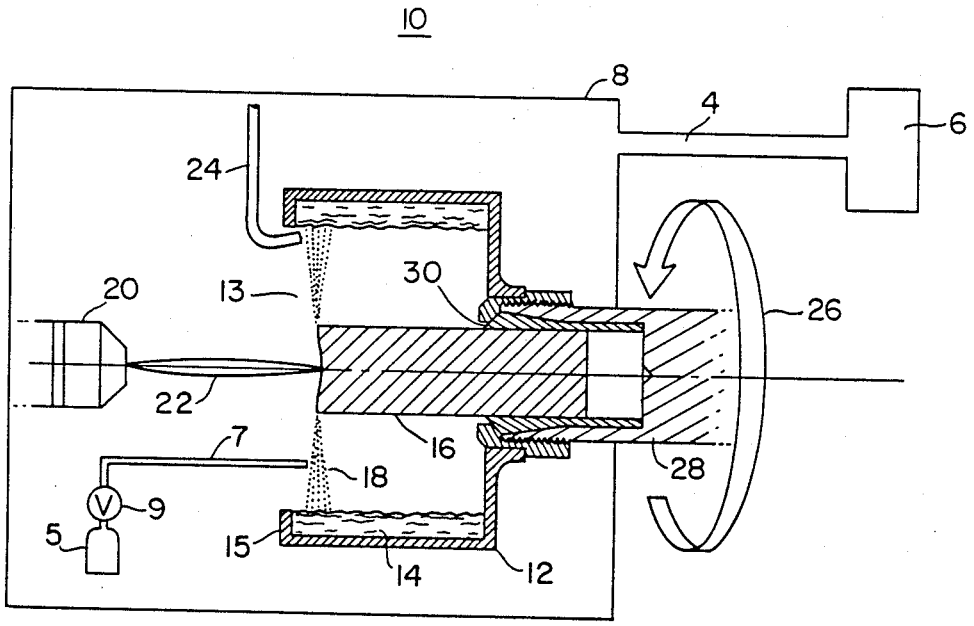
FIG. 1 is diagrammatic, cross-sectional, elevational view of an apparatus for producing fine metal powder according to this invention.

The method for producing fine metal powder according to this invention includes the steps of forming a centrifugally maintained annulus of a liquified gas quench medium on the inside surface of a rotating drum, forming molten metal drops within the eye of the annulus, urging the drops into the quench medium to solidify the drops, and boiling away the quench medium to leave behind clean, unentrained metal powder. Using liquified gas as the quench medium greatly simplifies the method and apparatus for producing fine metal powder and is particularly well suited for small production runs of specialty powders having a desired mean particle size.

The advantages of using liquified gas as the quench medium are several. First, powder/quenchant separation is extremely simple. Previously, the fine powder was separated from the liquid water quenchant by an elaborate series of separation tanks and/or extremely fine filter apparatus. This separation equipment added greatly to the overall size of the PREP equipment and its expense, and also contributed to the enormity of the effort required to clean the apparatus between production runs to prevent contamination of the powder being produced in the next run. By using liquified gas and operating the apparatus at or around room temperature, the quench medium quickly boils away after the quenching of the liquid metal into solid powder is complete. Since the ambient temperature is preferably well above the boiling point of the liquified gas, the atmospheric heating of the quench as well as the heat imparted by the liquid metal both contribute to its rapid boiling. As a result, when the powder-making run is complete, the clean, dry solidified powder particles are left behind within the drum rather than being entrained in the quench medium. There is no additional quenchant/powder separation step required. In addition, since the interior of the drum is the only part of the apparatus exposed to the extremely fine metal powder, it is the only part that must be thoroughly cleaned before the next run is begun. This greatly decreases machine down-time and cleaning labor costs and allows the economical production of small amounts of fine powders.

The liquified gas quench is also advantageous because of the extremely small size of the powder-making apparatus employing this quench. Because the quenching is performed in the cold liquid and not in an inert gas atmosphere as is typically done in the PREP process, there is no need for a large cooling chamber. Thus, the surface of the quench annulus can be held only inches from the rotating electrode or cup that creates the liquid metal drops. In addition, the liquid annulus need not be very thick because the minute particles cool more rapidly than larger particles, which decreases the immersion time of the metal drops in the quench medium necessary to solidify them before they impact the wall of the drum. Because of the small diameter and thickness of the quench annulus, the drum that carries the annulus need only be slightly larger than the electrode or cup that creates the liquid metal drops. For example, if a two inch diameter electrode is used, the drum is typically twelve inches or less in diameter.

The small size of the apparatus is also advantageous because the median particle size of the metal powder is indirectly proportional to the relative velocities of the liquid metal drop and the quench medium. The liquid metal drops are formed within the eye of the annulus by either melting a rotating consumable electrode which hurls drops into the annulus of quench medium, or by breaking up a stream of molten metal with a rotating cup or dish-shaped member that breaks the stream into drops and flings them into the quench medium. Since the velocity of the drops is proportional to the angular velocity of the rotating electrode or cup, the higher its speed of rotation the smaller the median particle size of the metal powder. Thus, it is desirable to have the angular velocity or speed of rotation of the electrode or cup as high as possible. It is also desirable to have a means of varying the angular velocity within a desired range to allow the particle size to be varied. Since the upper limit of the angular velocity of the structure being rotated is determined in part by its size and weight, the small size of the apparatus allows the electrode or cup to be rotated at speeds of up to 20,000 rpm, and the drum at up to 3000 rpm.

The relative velocities of the surface of the quench medium and the liquid metal drop can be further controlled by independently rotating the drum and the electrode or cup. Because of its small size, the electrode or cup can be rotated within a wide range of desired speeds. Since the drum is not much larger than the electrode or cup, it too can be rotated within a relatively wide range of speeds, by independently rotating the drum and electrode or cup, the relative velocities of the metal drop and the annulus surface can be controlled within an extremely wide range. Since particle size is indirectly related to relative velocity, the small apparatus size and concurrent control over relative velocity allows great control over median particle size, as well as a significant decrease in the smallest particle size obtainable.

There is shown in FIG. 1 apparatus 10 for producing fine metal powder. Consumable electrode 16 is a solid cylindrical bar of the metal that is being made into a powder. Electrode 16 could alternatively be an un-consumed hollow sleeve holding a metal powder to be consumed. Steel and titanium alloys are examples of fine metal powders that can be produced by apparatus 10, and for which there is a market for the small quantities typically produced. Drum 12 with open end 13 has lip 15 which keeps annulus 14 of liquified gas quench medium in place. The liquified gas is fed into the drum through tube 24. In this example, electrode 16 and drum 12 are rotated together as a unit through shaft 28 connected to a variable speed motor, not shown. Shaft 28 is threaded at one end and includes collet 30 that grasps electrode 16 to tightly hold it in place as it is rotated and consumed.

When electrode 16 and drum 12 are rotating at the desired speed in the direction indicated by arrow 26, plasma torch 20 is activated and supplies arc 22 to electrode 16. Arc 22 has a predetermined power to melt electrode 16 at a desired rate. The rotation of electrode 16 forms the molten metal into droplets 18 that are projected into quench medium 14. Depending on the melt rate, the liquid metal will leave electrode 16 as either drops, ligaments or sheets. In general, the slower the melt rate, the finer the metal droplets and the particles produced. Thus, control of electrode melt rate also contributes to control of particle size. Quench medium 14 quenches drops 18 into the extremely fine metal powder, and is replenished through feed tube 24 as it boils away due to the energy absorbed from the molten metal and the ambient atmosphere. Preferably, the thickness of the annulus is kept relatively constant to ensure proper solidification before the particles hit the wall of the drum. The ambient temperature is held proximate or above the boiling point of the quench medium by heater 6 that supplies warm cover atmosphere through conduit 4 to enclosure 8. Heater 6 may simply be the thermostatically controlled heat supply for the room or building in which the apparatus is located.

When electrode 16 is consumed, plasma torch 20 is extinguished and the quenchant feed is stopped. The remainder of the quench medium then quickly boils away, leaving behind the dry, clean powder. Drum 12 is then removed from spindle 28 by unscrewing it therefrom, and its contents simply poured out. Because only drum 12 and collet 30 have made contact with the powder, they are the only pieces that need to be cleaned of the residual powder before the apparatus is ready for another powder making run. In addition, there is no melting crucible that must be cleaned of residual metal before the next run. The electrode stub is simply discarded.

By controlling the radius of electrode 16 and annulus 14, the rotation rates of electrode 16 and drum 12, and the melt rate of electrode 16, the median particle size and the finest particle size can be controlled as desired. This method and apparatus is suitable for producing spherical and irregular metal powders with controlled mean diameters as small as 50 micrometers. The powders are extremely clean and are not oxidized because quench medium 14 is chosen as an inert or a relatively non-reactive substance. Using an inert or non-reactive liquified gas is especially important for applications in which ultra clean, extremely small metal particles are required, for example in the aerospace industry. Liquid argon is an example of an inert substance that is useful as the quench medium. Since argon has a boiling point of approximately −186 degrees C, it rapidly boils away when the operation is complete. Liquid nitrogen is also a relatively non-reactive and inexpensive, liquified gas useful with the method and apparatus according to this invention.

The incidence of particle contamination can be further decreased by providing an inert gas atmosphere around electrode 16 within the eye of annulus 14, which prevents oxidation of the liquified metal drops due to contact with air. This may be accomplished by providing cylinder 5 of inert gas, for example argon, with valve 9 for controlling the flow of gas through tube 7 into the eye of the annulus. However, if liquified argon is used, as it boils away it may either partially or completely provide this inert atmosphere, thereby obviating the need for separate injection of an inert gas into the eye of the annulus.

Figure 2A:
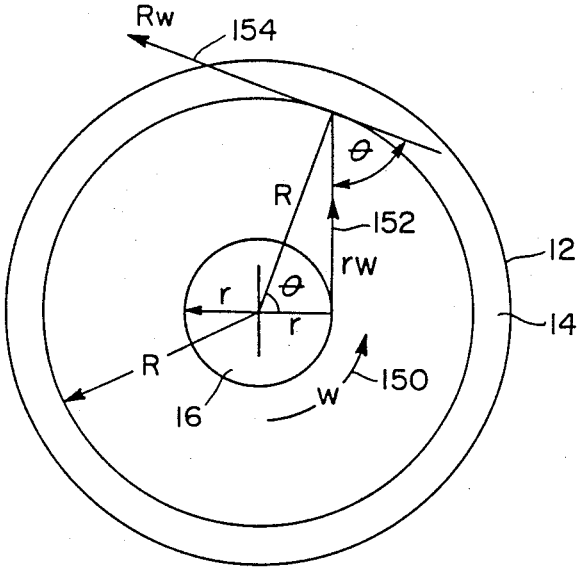
FIGS. 2A and 2B are schematic representations of a liquid metal drop being quenched in the liquified gas quench medium of the apparatus of FIG. 1.
Figure 2B:
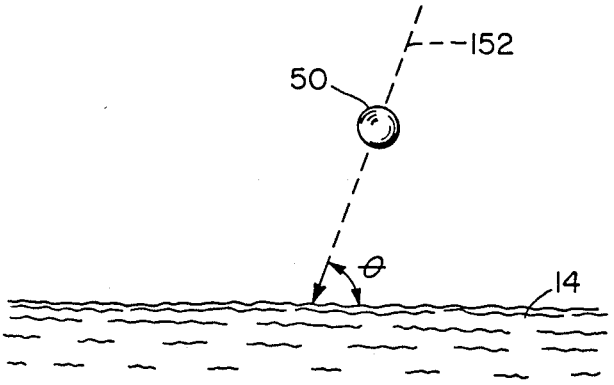

FIG. 2A is a schematic representation of the relative velocities of a liquid metal droplet being flung from electrode 16 rotating at angular velocity omega in the direction of arrow 150. Electrode 16 has a radius r and the surface of quench medium annulus 14 has a radius R. Droplets travelling along path 152 strike the surface of annulus 14 at angle theta. This is more clearly shown in FIG. 2B, in which liquid metal droplet 50 is travelling along path 152, shown in phantom, from electrode 16 toward the surface of quench annulus 14. Since the quench annulus and the electrode are rotated together in this example, the surface of annulus 14 has a velocity of $R_\omega$. The velocity of the drop in the direction of the movement of the surface is $r\omega\cos\theta$. The velocity differential between droplet 50 and the surface of annulus 14 is thus:

$$R\omega - r\omega\cos\theta \text{ or } \frac{\omega}{R}(R^2 - r^2).$$

The shear forces on the drop are what break it into the extremely small droplets that solidify to form the fine powder. These shear forces are caused by at least two phenomena. The violent localized boiling of the low boiling point quench that occurs when the liquid metal hits the quench annulus contributes to shear. This boiling is also advantageous because it forms an envelope of gas around the liquid droplet that may keep it liquid for a longer period of time, thus allowing it to be further divided by shear forces to create even smaller particles. Also, the shear forces have been shown to be proportional to the velocity differential between the drop and the quench. Thus, this velocity differential to some degree determines the median and finest particle sizes. As explained below, experimental results have established the relationship between the relative angular velocities of the quench annulus and the liquid metal drops and the mean and finest particle sizes. Thus, the method and apparatus of this invention is useful for creating particles with a desired mean particle size and particle size distribution, and also for producing particles that are much finer than those created by the existing PREP.

Figure 3:
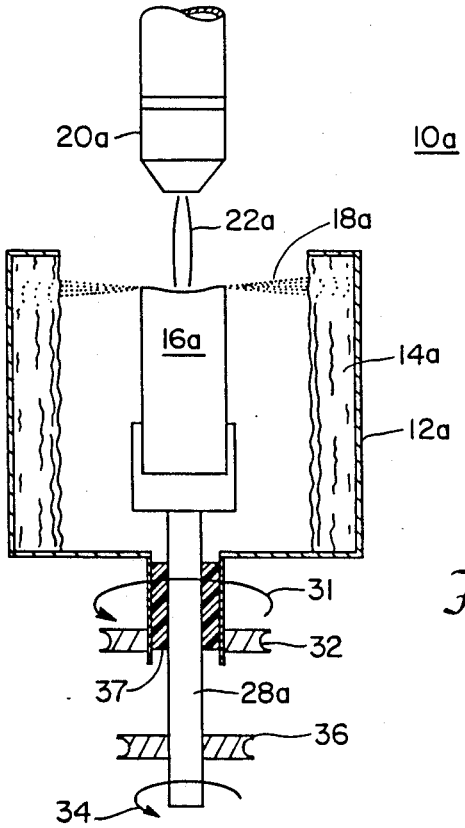
FIG. 3 is a diagrammatic, cross-sectional, elevational view of an alternative apparatus for producing fine metal powder.

Apparatus **10*a*, FIG. 3, is an alternative to the apparatus shown in FIG. 1. Drum 12*a* and electrode 16*a* are rotated independently; drum 12*a* is rotating in the direction of arrow 31, and electrode 16*a* driven by shaft 28*a* is rotating in the direction of arrow 34. Bearing and seal 37 keeps shaft 28*a* in place and seals the interior of drum 12*a*. Drum 12*a* is driven by a variable speed motor, not shown, that is connected by a drive belt to pulley 32. Likewise, electrode 16*a* is driven by a variable speed motor, not shown, connected by a drive belt to pulley 36. By independently controlling the direction and speed of rotation of electrode 16a and drum 12a, the differential velocity of liquid metal drops 18a and the surface of annulus 14a** can be chosen as necessary to produce powder with a desired mean particle size and distribution. This control also provides a finer absolute particle size because of the greatly increased relative velocity.

Figure 4:
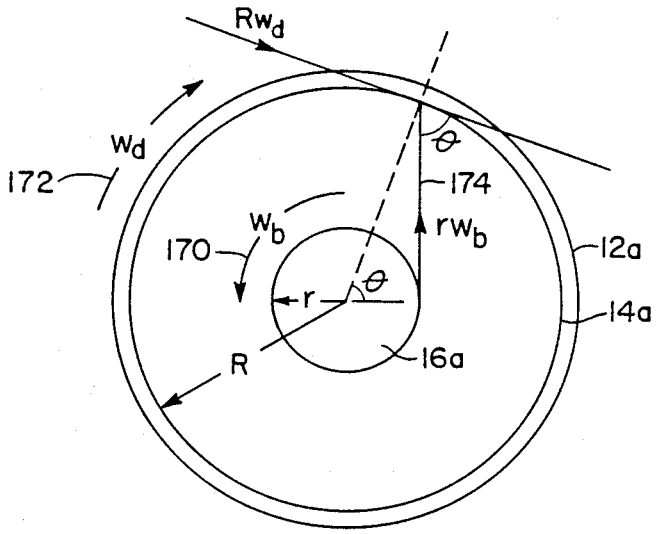
FIG. 4 is a schematic representation of a liquid metal drop being quenched in the liquified gas quench medium of the apparatus of FIG. 3.

The relationship between rotation rate and velocity differential for the apparatus of FIG. 3 is schematically shown in FIG. 4. Electrode 16a is rotating in the direction of arrow 170 with an angular velocity $\omega_b$. Drum 12a with annulus 14a of liquified gas quench medium is rotating in the opposite direction 172 with angular velocity $\omega_d$. Particles travelling along path 174 from electrode 16a have a velocity of $r\omega_b$. The velocity differential between the particles and the surface of annulus 14a is thus:

$$\frac{r^2}{R}\omega_b + R\omega_d.$$

Since independent rotation increases the range of achievable velocity differentials, it also provides a wider range of achievable powder particle sizes.

Figure 5:
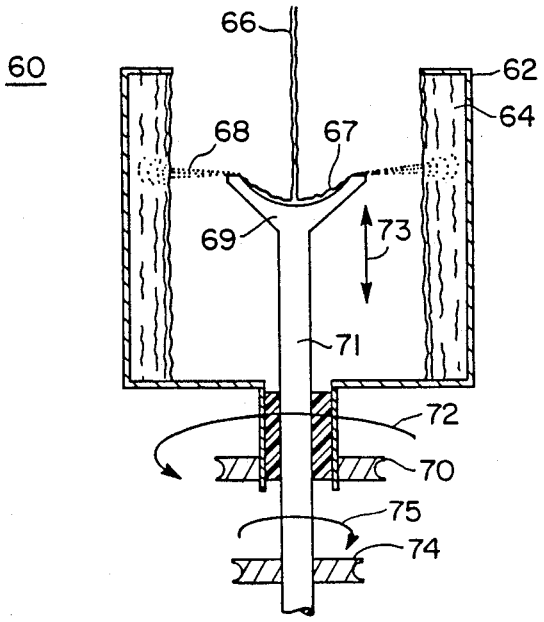
FIG. 5 is a diagrammatic, cross-sectional, elevational view of another alternative apparatus for producing fine metal powder.

Another apparatus for producing the fine metal powders is shown in FIG. 5. This apparatus is similar to the that shown in FIG. 3, except the consumable electrode is replaced by a rotating cup or dish-shaped member 69 that breaks molten metal stream 66 into small liquid metal droplets 68. Member 69 is rotated by shaft 71 turned through pulley 74 in the direction of arrow 75. Shaft 71 can preferably be moved in the direction of arrow 73 to spread the powder along the length of drum 62. Drum 62 is rotated in the opposite direction indicated by arrow 72 through pulley 70. Liquified gas quench medium annulus 64 quenches droplets 68 that are flung from the lip of cup 69. In operation, liquid metal stream 66 is formed by, for example, melting a solid electrode with a plasma torch or melting the metal in a crucible and pouring it. Rotating cup or dish-shaped member 69 is made from a relatively non-reacting or inert material, for example graphite, and catches stream 66 as it falls. The centrifugal force of rotating member 69 forces liquid 67 to travel up the face of cup 69. It is then quickly ejected as metal droplets 68, which are immediately plunged into annulus 64 to be quenched as described above.

Figure 6:
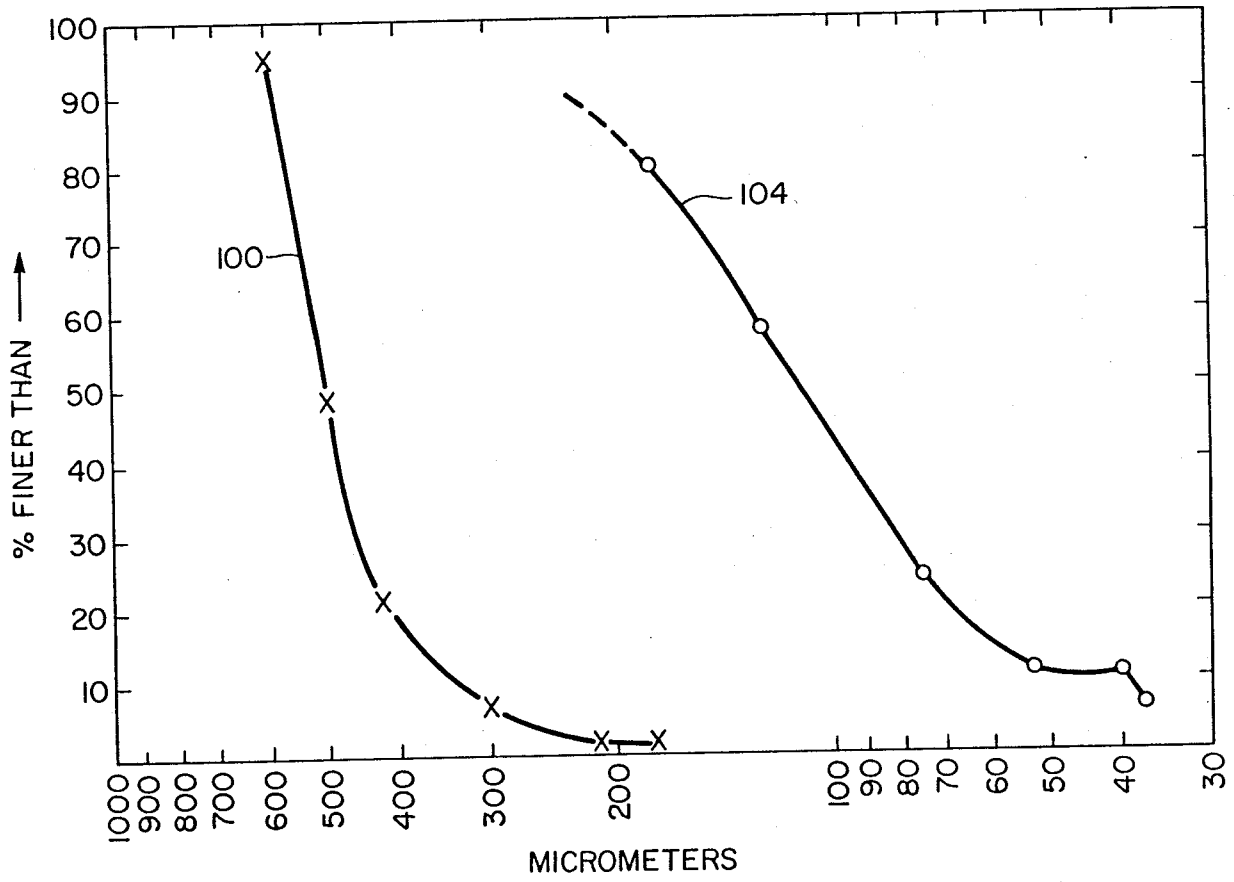
FIG. 6 is a particle size distribution plot showing the great decrease in particle diameter of metal powders made by the method and apparatus of the subject invention.

The results of two experimental series of powder making runs that illustrate the advantages of the method and apparatus of this invention are shown in FIG. 6, which is a particle size distribution plot with percent finer than on the ordinate and particle size on the abscissa. Line 100 is a plot of the particle size distribution for a traditional PREP process with an inert gas atmosphere and a large cooling chamber. A two-inch consumable titanium alloy electrode rotated at 5500 rpm was used in the process. The mean particle size was approximately 510 micrometers. Line 104 is a plot of runs using the method and apparatus of this invention in which an identical two-inch titanium electrode was melted. The electrode and the drum holding the liquified gas quench medium were rotating in the same direction at 5500 rpm. The radius of the quench medium was approximately 4 inches. The apparatus was operated at room temperature. The results show that the median particle size decreased dramatically to approximately 115 microns, with a significant quantity of particles in the 40 to 100 micrometer range. As is apparent, virtually all of the particles produced in run 104 were smaller than any of those produced in run 100. This is but one example of a number of experiments that have been performed which confirm the great decrease in particle sizes obtainable with the method and apparatus of this invention, and which have also confirmed that the mean particle size can be closely controlled with this method and apparatus.

As a result of using liquified gas as the quench medium, the PREP apparatus is much smaller, easier to clean, and more economical to operate than the apparatus of the prior art. As shown by FIG. 6, the method and apparatus produces a metal powder that is much finer than those produced by the prior art processes. Thus, it is ideally suited for producing the small amounts of extremely fine specialty metal powders currently in great demand.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A method for producing fine metal powder comprising the steps of forming a centrifugally maintained annulus of a liquified gas quench medium, forming molten metal drops within the eye of the annulus, urging the drops into the quench medium to solidify the drops, and boiling away the quench medium to leave behind clean, unentrained metal powder.

2. The method of claim 1 in which liquid argon is the quench medium.

3. The method of claim 1 in which liquid nitrogen is the quench medium.

4. The method of claim 1 in which the mllten metal drops are formed from a consumable electrode.

5. The method of claim 4 in which the consumable electrode is melted to form molten metal.

6. The method of claim 5 in which the consumable electrode is melted by a plasma torch that supplies an arc to the electrode.

7. The method of claim 5 in which the drops are urged into the quench medium by rotating the electrode.

8. The method of claim 1 in which the molten metal drops are formed by breaking up a molten metal stream.

9. The method of claim 8 in which a rotating member breaks the stream into drops and projects them toward the annulus.

10. The method of claim 9 in which the rotating member is made from a relatively inert material that does not react with the molten metal.

11. The method of claim 1 in which the annulus is formed on the inside surface of a rotating drum.

12. The method of claim 11 in which the drops are urged into the quench medium by a rotating member that flings the drops into the annulus.

13. The method of claim 12 in which the drum and the rotating member are rotating in opposite directions.

14. The method of claim 12 in which the drum and the rotating member are independently rotating.

15. The method of claim 11 in which the drum is rotating at a variable angular velocity.

16. The method of claim 12 in which the rotating member is rotating at a variable angular velocity.

17. The method of claim 12 in which the rotating member is rotating at up to 20,000 rpm.

18. The method of claim 1 in which the quench medium is replenished as it evaporates to maintain an annulus with a substantially constant thickness.

19. The method claim 1 including the further step of providing an inert gas atmosphere within the eye of the annulus to prevent powder contamination.

20. The method of claim 1 in which the quench medium is boiled away by maintaining an ambient temperature proximate the boiling point of the liquified gas.

21. A method of producing fine metal powder by quenching molten metal drops into a liquified gas quench medium comprising the steps of:

rotating a drum with at least one partially open end at speeds up to 3000 rpm;

supplying a liquified gas to the inside of the drum to form an annulus of quench medium within said drum;

placing a metallic consumable electrode within the drum and along its longitudinal axis;

rotating the electrode;

melting the electrode with a plasma torch that supplies an arc to the electrode and forms metal drops that are flung into the quench medium to solidify; and boiling away the quench medium to leave behind clean, unentrained metal powder.

22. The method of claim 21 including the further step of replenishing the quench medium as it evaporates to maintain an annulus with a substantially constant thickness.

23. An apparatus for producing fine metal powder comprising:

a drum for containing a liquified gas quench medium;

means for addin9 liquified gas to the inside of said drum;

means for rotating said drum to form an annulus of quench medium;

means for forming molten metal to be made into powder;

means, disposed along the longitudinal axis of said drum and within the eye of the annulus, for forming molten metal drops;

means for urging the drops into the quench medium to solidify the drops; and means for boiling away the quench medium to leave behind clean, unentrained metal powder.

24. The apparatus of claim 23 in which said means for boiling away the quench medium includes means for maintaining the ambient temperature proximate the boiling point of the liquified gas.

25. The apparatus of claim 23 furthr including means for replenishing said medium as it evaporates.

26. The apparatus of claim 23 further includin9 means for rotating said means for urging.

27. The apparatus of claim 26 in which said means for rotating turns said means for urging at up to 20,000 rpm.

28. The apparatus of claim 23 in which said means for forming includes a consumable electrode.

29. The apparatus of claim 28 in which said means for forming further includes means for melting said electrode.

30. The apparatus of claim 29 in which said means for melting includes a plasma torch for supplying an arc to said electrode.

31. The apparatus of claim 23 in which said means for forming includes means for breaking up a molten metal stream into drops.

32. The apparatus of claim 31 in which said means for breaking includes a rotating member for projecting the drops toward the annulus.

33. The apparatus of claim 32 in which said rotating member is made of a relatively inert material that does not react with the molten metal.

34. The apparatus of claim 26 in which the drum and the means for urging are rotating in opposite directions.

35. The apparatus of claim 23 in which said means for rotating said drum includes means for varying the angular velocity of said drum.

36. The apparatus of claim 26 in which said means for rotating said means for urging includes means for varying the angular velocity of said means for urging.

37. The apparatus of claim 25 in which said means for replenishing maintains the annulus of quench medium at a substantially constant thickness.

38. The apparatus of claim 23 further including means for providing an inert atmosphere within the eye of the annulus to prevent powder contamination.

39. The apparatus of claim 23 in which said drum has at least one partially open end for speeding liquified gas evaporation.

* * * * *